United States Patent [19]

Redington

[11] 4,339,687

[45] Jul. 13, 1982

[54] SHADOW MASK HAVING A LAYER OF HIGH ATOMIC NUMBER MATERIAL ON GUN SIDE

[75] Inventor: Rowland W. Redington, Schenectady, N.Y.

[73] Assignee: General Electric Company, Schenectady, N.Y.

[21] Appl. No.: 154,221

[22] Filed: May 29, 1980

[51] Int. Cl.[3] ..... H01J 29/07

[52] U.S. Cl. ..... 313/402; 313/311

[58] Field of Search ..... 313/402, 403, 466

[56] References Cited

U.S. PATENT DOCUMENTS

| | | | |
|---|---|---|---|
| 2,663,821 | 12/1953 | Law | 313/402 X |
| 3,525,679 | 8/1970 | Wilcox et al. | 313/466 X |
| 3,885,190 | 5/1975 | Taniguchi et al. | 313/402 |

FOREIGN PATENT DOCUMENTS

| | | | |
|---|---|---|---|
| 2421106 | 2/1974 | Fed. Rep. of Germany | 313/402 |
| 46-19495 | 6/1971 | Japan | 313/466 |
| 55-28205 | 2/1980 | Japan | 313/466 |

*Primary Examiner*—Robert Segal

*Attorney, Agent, or Firm*—Geoffrey H. Krauss; James C. Davis, Jr.; Marvin Snyder

[57] ABSTRACT

A cathode ray tube of the shadow mask type has a layer of high atomic number material fabricated upon the shadow mask surface nearest to at least one electron gun, to increase backscatter of electrons impinging upon the non-aperture areas of the shadow mask, thereby reducing local heating of the mask and maintaining color purity of the cathode ray tube even at increased brightness levels.

1 Claim, 1 Drawing Figure

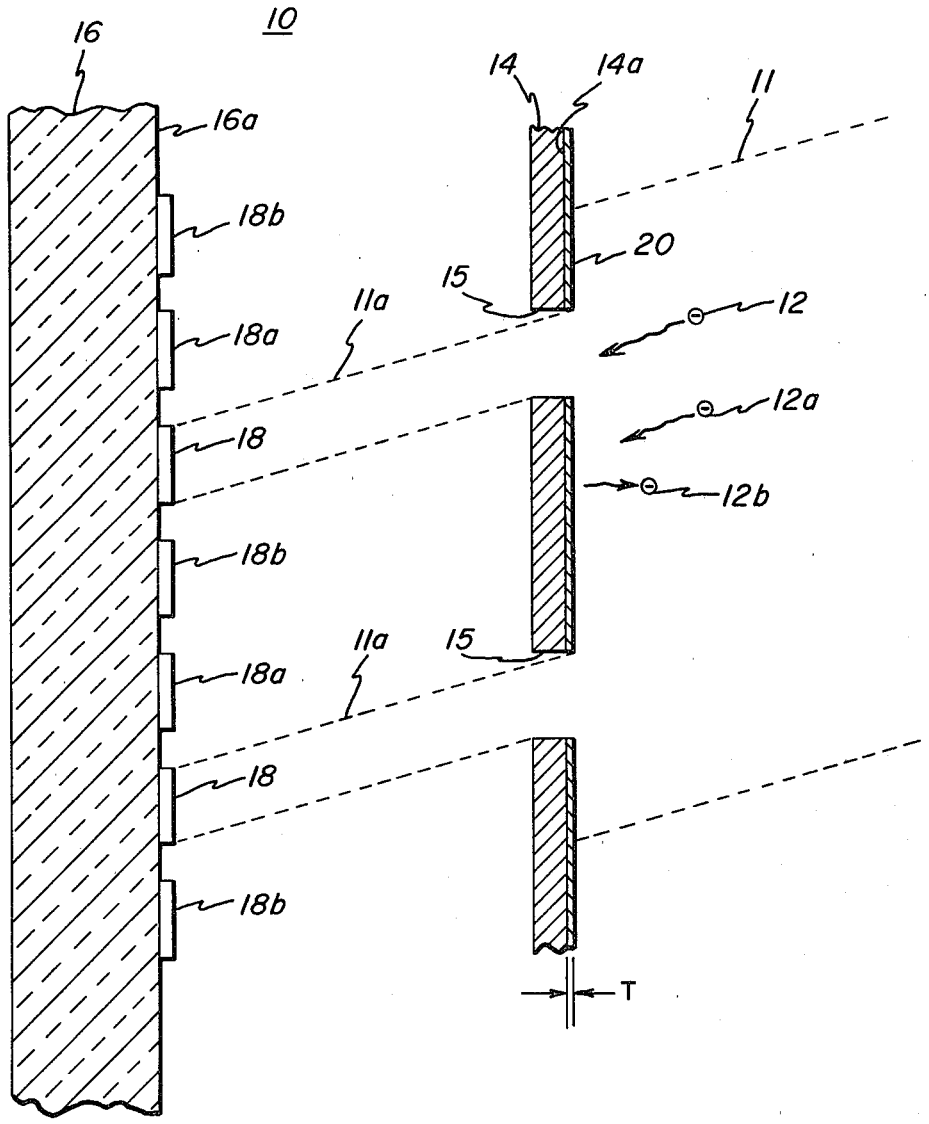
10
16
16a
18b
18a
18
18b
18a
18
18b
14
14a
11
20
15
11a
12
12a
12b
11a
15
T

SHADOW MASK HAVING A LAYER OF HIGH ATOMIC NUMBER MATERIAL ON GUN SIDE

BACKGROUND OF THE INVENTION

The present application concerns cathode ray tubes of the apertured shadow mask type and, more particularly, a novel shadow mask cathode ray tube having a layer of high atomic number material for providing increased backscattering whereby higher peak brightness is achieved with acceptable color errors.

It is known to provide cathode ray tubes, particularly of the type utilized for color television, with a shadow mask, comprised of steel and the like materials, having a multiplicity of apertures therein. An electron beam, provided by at least one electron gun, selectively illuminates sequential ones of the apertures in the shadow mask, to provide portions of each electron beam impingent upon phosphor elements fabricated upon the rear of the cathode ray tube faceplate. A portion of each electron beam does not pass through the particular aperture at which that beam is directed, but impinges upon the shadow mask, causing localized heating thereof. Local heating of the shadow mask, especially in high-brightness portions of the display image, causes local expansion of the mask and generates color errors. Thus, one fundamental limitation upon the peak brightness of an apertured shadow mask cathode ray tube is the local heating of the aperture mask responsive to incidence of the scanned electron beam thereon.

STATE OF THE ART

It is known to increase the mechanical strength of the shadow mask to reduce distortion, as disclosed and claimed in U.S. Pat. No. 3,885,190, issued May 20, 1975, to Taniguchi, et al. It is also known that increased thermal dissipation may be provided, for electron-beam-induced heating of the shadow mask, by radiation from the mask, as taught and claimed in U.S. Pat. No. 2,728,008, issued Dec. 20, 1955 to Burnside and in U.S. Pat. No. 3,935,036, issued Jan. 27, 1976 to Kinsch, wherein dark adherent coatings provide increased heat radiation from a surface of the shadow mask furthest from the phosphor-carrying faceplate. It is also known that heat energy radiated from the shadow mask surface facing the phosphor-carrying faceplate may be absorbed by heat-absorptive material located on the rear surface of the faceplate itself, as taught in U.S. Pat. No. 3,392,297, issued July 9, 1968 to Schwartz, and in U.S. Pat. No. 3,878,427, issued Apr. 15, 1975 to Godfrey. Further, it is also known to reduce the temperature of the shadow mask by providing an incident-electron-absorbing layer between the electron gun(s) and the shadow mask, but with the absorbing layer in poor thermal contact with the shadow mask, as taught in U.S. Pat. No. 3,887,828, issued June 3, 1975, to Bathelt, et al. All of the prior art cathode ray tubes allow absorption of the beam electrons in the shadow mask, with subsequent use of mechanical or thermal elements for removing the resultant heat energy.

BRIEF SUMMARY OF THE INVENTION

In accordance with the invention, a layer of a high atomic number material is fabricated upon that surface of a shadow mask upon which at least one scanned electron beam is incident, with the high atomic number material being selected to provide a high backscattering ratio for those electrons impingent upon the shadow mask, and not passing through apertures therein. The backscattered electrons are not converted into heat energy in the shadow mask, thereby providing reduced localized shadow mask heating. Thus, the scanned electron beam(s) may be of greater intensity, to provide greater display peak brightness, without exceeding the amount of shadow mask heating which provided a desired degree of color purity, in a cathode ray tube devoid of the increased backscattering layer.

In presently preferred embodiments of my novel improved peak brightness aperture-mask cathode ray tube, the film of material, such as tungsten or gold, has an atomic number greater than 28. The film has a preferred thickness between about 1,000 and about 5,000 angstroms, and provides between 12 percent and 24 percent thermal improvement, relative to an apertured shadow mask fabricated of iron or steel.

Accordingly, it is an object of the present invention to provide an improved peak brightness apertured shadow mask cathode ray tube, having a layer of high atomic number material fabricated upon the shadow mask for increasing the backscattering of electrons incident thereon.

This and other objects of the present invention will become apparent upon consideration of the following detailed description, when read in conjunction with the drawing.

BRIEF DESCRIPTION OF THE DRAWING

The sole FIGURE is a sectional side view of a portion of a CRT faceplate and associated portion of an apertured shadow mask having a high-backscattering layer, in accordance with the principles of the present invention.

DETAILED DESCRIPTION OF THE INVENTION

Referring to the sole FIGURE, wherein dimensions are exaggerated for purposes of illustration, a portion of a cathode ray tube (CRT) 10 is shown. At least one beam 11 of electrons 12 is emitted by one or more electron guns (not shown) toward the rear surface 14*a* of a shadow mask 14. The shadow mask is typically fabricated of steel, and has an array of a multiplicity of apertures 15 formed therethrough. Those electrons 12 passing through one of apertures 15 continue, as beams 11*a*, toward the rear surface 16*a* of a faceplate 16. A plurality of phosphor elements 18 are deposited, as dots, stripes and the like configured formations, upon CRT faceplate rear surface 16*a*. In a color television CRT 10, for example, three electron guns are utilized to provide three electron beams 11, each passing through an aperture 15 at a different angle, and continuing thereafter as electron beams 11*a* impingent upon different ones of phosphor elements 18. As is well-known, the phosphor elements fluoresce and emit light when electrons of the beams are incident thereon, with each individual phosphor element producing light of one of a plurality typically three, of visible colors. As is also well-known, some of the beam electrons 12*a* impinge upon the solid portions of shadow mask 14, causing localized heating thereof. The local heating of the shadow mask causes local expansion, whereby the surface of the shadow mask is distorted and electron beams 11*a* do not squarely impinge upon the intended phosphor element 18, but may, for instance, impinge upon adjacent phosphor elements 18*a* and/or 18*b*, resulting in reduced color purity.

In accordance with the invention, fabricated upon mask rear surface 14*a* is a layer 20 of a high atomic number (Z) material, which material has a backscattering ratio greater than the backscattering ratio of the material (typically, iron or steel) from which apertured shadow mask 14 is fabricated. By use of a high-Z material having an increased backscattering ratio, a larger proportion of beam electrons 12*a*, incident upon non-aperture portions of mask 14, are reflected as backscattered electrons 12*b* and are not absorbed within the mask. Thus, by increasing the number of backscattered electrons, the number of electrons having their kinetic energy converted into heat energy in the mask, is reduced. Accordingly, a CRT having acceptable color errors, and therefore an acceptable amount of heat energy being dissipated within mask 14, at a given intensity of beam 11 for a mask devoid of layer 20, will have the same amount of heat energy dissipated within the mask (and therefore the same amount of heat-dissipation-limited color errors) with a more intense beam 11, when layer 20 is utilized.

In one presently preferred embodiment, backscattering layer 20 is fabricated, as by vacuum evaporation, sputtering, vapor deposition and the like, of tungsten. Tungsten has a backscattering ratio of 47 percent at typical electron-beam acceleration potentials on the order of 30 kV. Typically, a shadow mask formed of iron will reflect about 13 percent of the incident electron beam power while a shadow mask of iron having a tungsten layer 20 fabricated upon the rear surface 14*a* thereof, will reflect between about 18 and 24 additional percent of the incident electron beam power, relative to a steel mask. Advantageously, layer 20 will have a thickness T of between about 1,000 angstroms and about 5,000 angstroms, with a film thickness T of about 3,000 angstroms being preferred for a tungsten layer. Layer 20 may also be fabricated of other high-Z materials having atomic numbers greater than 28; a layer of gold, advantageously having a 1,500 angstroms thickness, provides an additional 12 percent to 18 percent of incident electron beam power reflection, relative to the steel mask. Typically, backscattered electrons 12*b* have about one-half the energy of the primary beam electrons 12*a* and an increase in x-ray production (of about 127 percent for gold and about 160 percent for tungsten films 20) has been noted; known techniques may be utilized for preventing emission of this increased X radiation from the CRT.

There has just been described an apertured shadow mask cathode ray tube capable of improved peak brightness, by the use of a novel layer of high atomic number material fabricated upon the surface of the shadow mask upon which a scanned electron beam impinges.

While the present invention has been described with respect to several presently preferred embodiments thereof, many modifications and variations will now occur to those skilled in the art. It is my intent, therefore, to be limited only by the scope of the appending claims and not by the specific details recited herein.

What is claimed is:

1. In a cathode ray tube of the type having at least one electron beam directed through apertures of a shadow mask for impingement upon at least one phosphor element, deposited upon the rear surface of the faceplate, and associated with each shadow mask aperture, the improvement comprising:

a layer of a material, having an atomic number greater than 28 selected from a group consisting of tungsten of a thickness of about 3,000 angstroms and gold of a thickness of about 1,500 angstroms, fabricated upon substantially all of the non-apertured surface of said shadow mask upon which said at least one electron beam impinges; said material being characterized by a backscattering ratio greater than the backscattering ratio of the material from which said mask is fabricated, and causing a greater percentage of beam electrons impingent upon said mask to backscatter, relative to the percentage of electrons backscattered from said mask without said layer.

* * * * *